US005299702A

United States Patent [19]

Kneer et al.

[11] Patent Number: 5,299,702

[45] Date of Patent: Apr. 5, 1994

[54] STOPPER FOR A RECEPTACLE

[75] Inventors: Roland Kneer, Farchant; Christoph Heiland, Saulgrub, both of Fed. Rep. of Germany

[73] Assignee: GAPLAST GmbH, Fed. Rep. of Germany

[21] Appl. No.: 965,211

[22] Filed: Oct. 23, 1992

[30] Foreign Application Priority Data

Oct. 15, 1991 [DE] Fed. Rep. of Germany ..... 4134082

[51] Int. Cl.[5] ..... B65D 17/40

[52] U.S. Cl. ..... 215/256; 215/299; 215/364

[58] Field of Search ..... 215/254, 256, 296, 305, 215/354, 355, 364, 253, 249, 303, 304, 299, 300; 220/260, 262, 276

[56] References Cited

U.S. PATENT DOCUMENTS

| | | | |
|---|---|---|---|
| 2,754,989 | 7/1956 | Sherock et al. | 215/304 |
| 3,430,777 | 3/1969 | Esposito, Jr. | 215/256 |
| 4,358,022 | 11/1982 | Geiger | 215/224 |
| 4,458,819 | 7/1984 | Geiger | 215/224 |
| 5,129,531 | 7/1992 | Beck et al. | 215/256 |

*Primary Examiner*—Allan N. Shoap
*Assistant Examiner*—Nova Stucker
*Attorney, Agent, or Firm*—Juettner Pyle & Lloyd

[57] ABSTRACT

A safety stopper for a receptacle includes a top portion and a sealing ring having an inner bead embraced around a rib at the receptacle opening. The stopper is press fitted into the receptacle. A weakened seam is provided between the top portion and the sealing ring. A slide may be provided in the top of the stopper and is moved outward to enable the stopper to be removed after the seam is broken. The stopper may also include a segment which blocks movement of the slide until the sealing ring is removed.

13 Claims, 2 Drawing Sheets

STOPPER FOR A RECEPTACLE

BACKGROUND OF THE INVENTION

This invention relates to a stopper for a receptacle that is preferably in the shape of a bottle and is, in particular, intended for receiving pills, dragées or also other substances, e.g. in powder or granular form. The stopper is provided with a tear-off sealing ring surrounding the edge of the receptacle opening, such as the neck of the receptacle, for ensuring the original state of the contents of the receptacle, and said ring having an inner projection gripping below an outwardly oriented annular projection of the receptacle.

Such stoppers are known. These have a tear-off sealing ring which grips below an outer annular projection on the neck of the receptacle with a bead having, for instance, the shape of a truncated cone when viewed in cross-section. These stoppers have the disadvantage that when they are made from a material having some flexibility, they may be lifted off from the receptacle neck without damage to the predetermined break seam of the sealing ring. As a result, they do not adequately fulfill their function of ensuring the original state of the contents of a receptacle.

Therefore, EP 0 202 506 A2 discloses a stopper as a receptacle closure whose outer wall, which covers the receptacle edge, is connected via tear-off webs to a sealing ring used for ensuring an original state. The sealing ring comprises tabs on its inner surface which are obliquely oriented into the opening direction and grip below a flanged edge of the receptacle. This known stopper can only be removed from the receptacle if the sealing ring has been removed, so that the undamaged state of the sealing ring guarantees that the receptacle content is originally filled-in preparation in its original state.

This known stopper has the disadvantage that it requires an expensive injection molding tool with slides which grip the obliquely upwardly facing tabs from behind. The production of the stopper is therefore very expensive. It is also disadvantageous that recesses must be formed in the head portion of the stopper for the slides.

DE-OS 30 19 180 discloses a childproof sealing stopper in the cover of which a slide is integrally aligned for being pushed laterally beyond the cover edge to remove the stopper. This sealing stopper has no means for ensuring an original state.

SUMMARY OF THE INVENTION

It is the object of the present invention to improve a stopper of this type such that the original state of the contents of the receptacle is ensured with the aid of simple and inexpensive means. Furthermore, a receptacle will be shown for said stopper.

According to the present invention, the stopper engages into the receptacle opening with the aid of a so-called olive in a press fit or clamping seat and is provided with a laterally movable slide which acts as an additional childproof device and serves as a means for removing the stopper from the receptacle after the removal of the sealing ring. The slide can be pushed laterally beyond the edge of the stopper or the neck of the receptacle. Furthermore, the sealing ring has a greater outer diameter than the head portion of the stopper to which the sealing ring is connected via a circular predetermined break seam whose diameter is thus smaller than the outer diameter of the sealing ring. Furthermore, the upper end of sealing ring has a blocking circumferential section which has an attachment that is not connected to the head portion of the stopper. The attachment projects into the advance path of the slide so that the slide cannot be pushed laterally outward into the position which provides a gripping surface for removing the stopper from the receptacle.

Such a configuration reliably prevents the sealing ring from being lifted from the receptacle because upon the application of a corresponding force below the lower edge of the sealing ring, the predetermined break seam would tear open because the central head portion of the stopper is held in a clamping seat on or in the receptacle opening, and said head portion does not offer a surface for the application of a pulling force which would be capable of overcoming the clamping seat of the stopper in the receptacle. The slide cannot be pushed forward beyond the edge of the stopper or the receptacle opening as long as the sealing ring is attached, as this ring has an upper attachment which prevents the slide from advancing into its extended position.

The radially inner bead of the sealing ring has, for instance, the shape of a truncated cone or a triangle when viewed in cross-section, whereby this annular projection can be made in a simple and inexpensive way by removal from the mold. For example, an inner core of the injection mold is removed after the formation of the sealing ring under expansion of said ring. Stopper removal is reliably prevented by the predetermined break seam which is radially offset inwards relative to the circumferential wall of the sealing ring under whose lower edge the force required for lifting off would have to be applied, and by the clamping seat of the stopper in the receptacle opening, which seat cannot be undone from the outside.

The predetermined break seam may be formed by a notch or by tear-off webs.

The sealing ring preferably comprises a substantially cylindrical circumferential wall surrounding the upper edge or neck of the receptacle, and a circular or annular wall which is bent inwards by about 90° and which is connected via the circularly surrounding predetermined break seam to the head portion, except for the blocking circumferential section. The blocking circumferential section is not connected to the head portion of the stopper. This can be accomplished during the injection molding operation or by subsequent cutting operation.

In accordance with the invention, the circular wall of the sealing ring should rest on the upper edge of the receptacle opening in the mounted position of the stopper on the receptacle. In the area of the blocking circumferential section the circular wall has, at least in places, a greater wall thickness than in the area of the remaining sealing ring, which is of special advantage. As a result, the circular wall section of the blocking circumferential section is automatically put upright in the mounted position of the stopper. The dimensions are chosen such that outward movement of the slide of the stopper beyond the edge of the receptacle is reliably prevented as long as the sealing ring with the blocking circumferential section is mounted on the stopper. As a result of the blocking of the slide, the stopper cannot be removed without the predetermined break seam being damaged.

Preferably, the corner portion of the blocking circumferential section has a reduced cross-sectional thickness, so that the circular wall section can be bent upwards in the manner of an integral hinge. The cross-sectional thickness can be reduced by an inwardly molded notch.

The blocking circumferential section may have a width which substantially corresponds to the width of the slide. It is important to note that the blocking circumferential section has such a width that the blocking upper wall section cannot be bent away outwards—owing to its circular arcuate shape—for unblocking the path for the slide. Instead of an integral hinge, the cylindrical part and the circular part of the blocking circumferential section may be connected by a weakened break seam.

Under another aspect of the invention the blocking circumferential section may be connected to the remaining sealing ring via at least one predetermined break seam which is preferably vertical, i.e. extends approximately in parallel with the longitudinal axis of the receptacle. Furthermore, the blocking circumferential section may communicate with the sealing ring via an integral hinge which is circumferentially spaced from the break seam and is preferably vertical as well, thereby facilitating the tearing off of the sealing ring. Instead of an integral hinge, a second predetermined seam may also be formed.

The receptacle of the invention which cooperates with the stopper has an outer annular projection or rib which engages with the radially inner annular bead of the sealing ring. This annular projection of the receptacle may advantageously comprise an outwardly projecting holding wall which is substantially at right angles with the longitudinal axis of the receptacle and under which the annular bead of the sealing ring snaps in place when the stopper is inserted into the container opening.

Furthermore, the blocking circumferential section is not provided with the annular bead according to the invention. This construction has the advantage that the predetermined break points between the blocking circumferential section and the remaining sealing ring do not tear open when the inner core is removed during removal from the mold. This advantageous measure does not impair the tamperproof features of the receptacle.

The head portion of the stopper preferably has a cylindrical base section resting on a recessed annular shoulder of the receptacle. The upper edge of the cylindrical base section is preferably in alignment with the upper edge of the receptacle opening, so that the slide next to the cylindrical base section, when viewed in axial direction, closely projects over the edge of the receptacle after the sealing ring is removed.

In an especially advantageous embodiment the cylindrical base section of the head portion is provided with a conical section which terminates in a substantially flat upper side of the stopper. The structure provides no gripping surface for undoing the clamping seat of the stopper in the receptacle opening, so that this is only possible in the extended state of the slide. Access to the contents of the receptacle by children is thereby made impossible.

It should be noted that the slide should be substantially flush with the upper side of the head portion, so that it does not offer a gripping surface in the non-extended position.

The stopper of the invention is both a reliable means for ensuring an original state and a childproof device and has also the advantage of a relatively simple inexpensive production. A preferred material for the stopper is polyethylene, the invention being of course not limited to this material. The small bottle of the invention is preferably made of glass; plastic materials, such as polypropylene, can of course be used as well.

Other features, advantages and details of the invention will become apparent from the following description of a preferred embodiment taken in conjunction with the drawing, in which:

THE DRAWINGS

DESCRIPTION OF THE PREFERRED EMBODIMENTS

Figure 1:
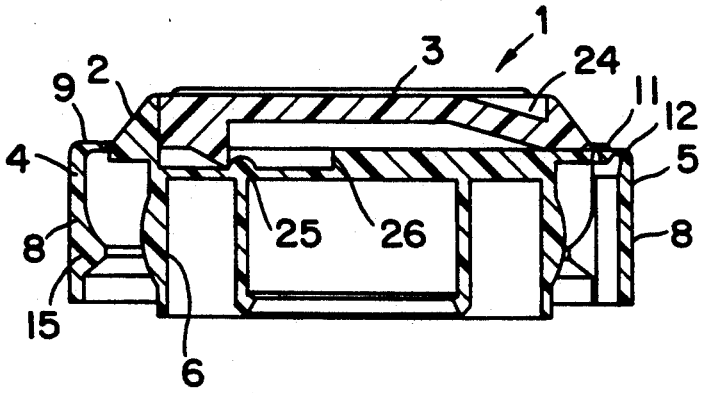
FIG. 1 is a longitudinal section through a stopper of the invention.
Figure 2:
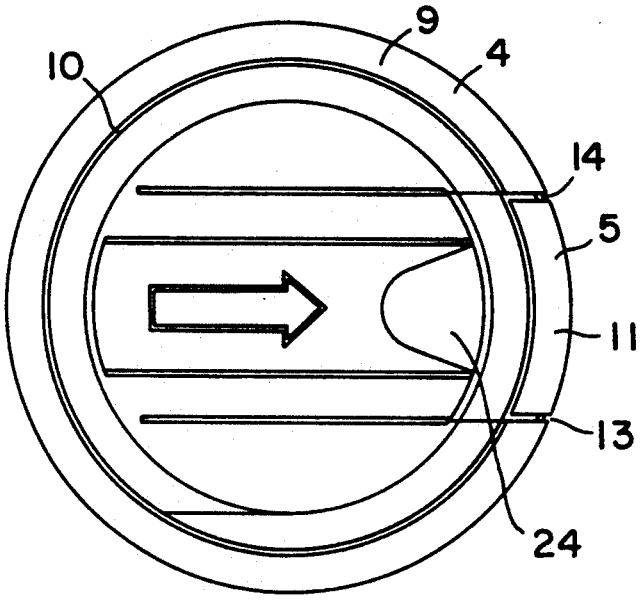
FIG. 2 is a top view on the stopper of FIG. 1.
Figure 3:
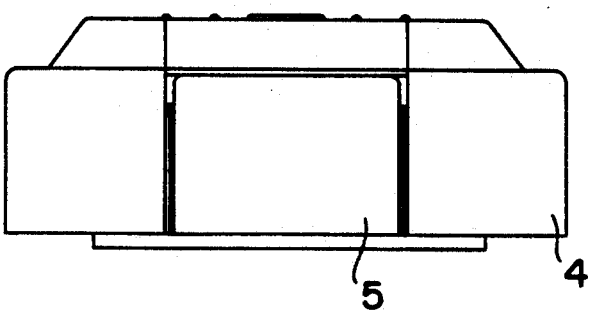
FIG. 3 is a side view of the stopper of FIG. 1 in the direction of arrow A.

Stopper 1 normally comprises a head portion 2 in which a slide 3 serving as a childproof device is displaceably inserted, a sealing ring 4 with a blocking circumferential segment or section 5, as well as a member 6 which is normally referred to as an olive and engages into the opening of a bottle-shaped receptacle 7 (FIG. 4) and is held there by means of a press fit or clamping seat.

The sealing ring 4 of stopper 1 includes a cylindrical section 8 which is bent inwardly by 90° at its upper end and is continued in a circular or annular section 9 which is connected via a circular predetermined break seam 10 to head portion 2. This, however, does not apply to the blocking circumferential segment 5 which also includes a cylindrical edge section 8 and an annular wall section 11 which is radially bent inwardly by 90°, but which is not connected to the head portion 2 but terminates at a free end.

This wall section 11 is connected to a corner portion 12 of a reduced cross-sectional size and the cylindrical portion 8, whereby wall section 11 is slightly pivotable and has a wall thickness greater than that of the horizontal wall section 9 of the remaining sealing ring 4.

The blocking circumferential segment 5 is connected, on the one hand, through a vertical predetermined break seam 13 and, on the other hand, through an integral hinge 14 to the rest of the sealing ring 4. The horizontal wall section 11, however, is not connected to the circular wall section 9 of sealing ring 4.

Figure 4:
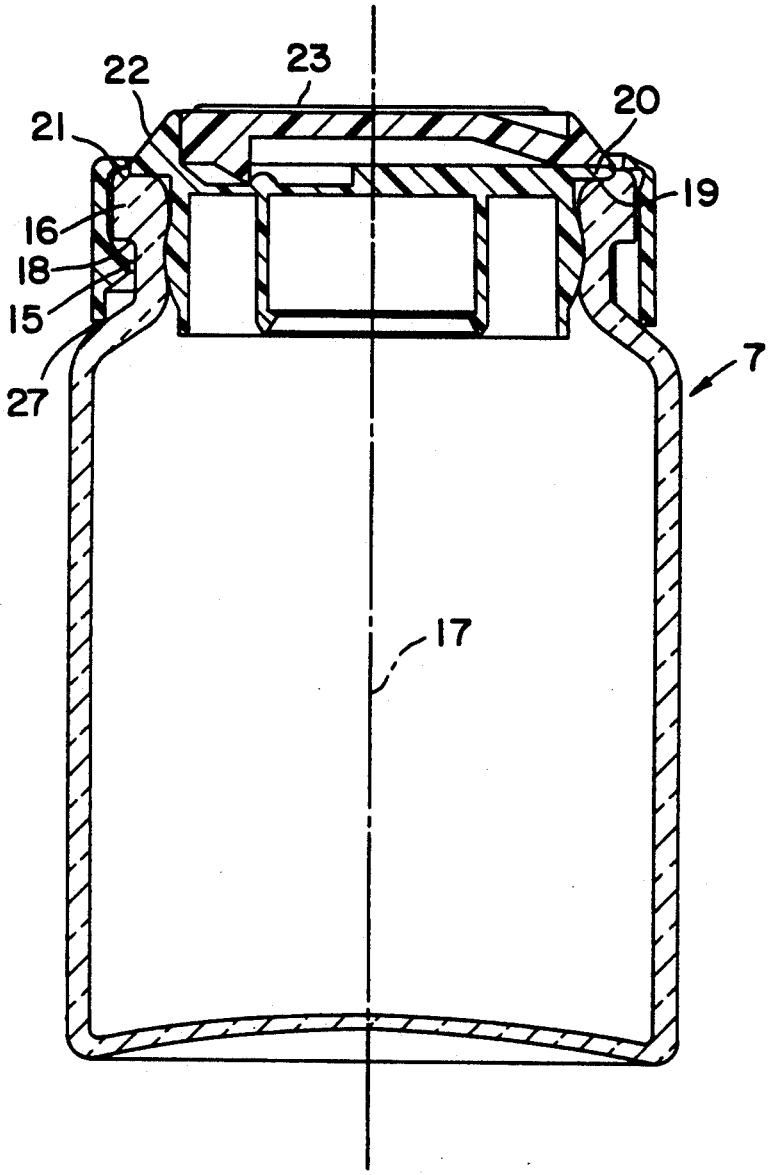
FIG. 4 is a longitudinal section through the stopper and a receptacle of the invention in the mounted position.

As shown in FIG. 4, sealing ring 4 includes a radially inner bead 15 which has a cross-section with about the shape of a truncated cone and which in the mounted position grips below an annular outer attachment 16 of receptacle 7, namely, a wall surface 18 which extends in a direction vertical to the longitudinal axis 17 of receptacle 7. The blocking circumferential section 5 is not provided with an annular bead 15 in order to permit removal from the mold without the predetermined break seam 13 being damaged.

A stepped annular shoulder 19, which is engaged by a cylindrical base section 20 of head portion 2 of stopper 1, is formed on the upper edge of the bottle-shaped receptacle 7. The upper edge of the cylindrical base section 20 is approximately in alignment with the upper edge of the upwardly projecting annular projection 21 of receptacle 7. Since wall section 11 has a greater thickness and is connected by a type of integral hinge to the cylindrical wall section 8, wall section 11 of the blocking circumferential section 5 is bent upwards thereby and blocks outward movement of slide 3.

The head portion 2 of stopper 1 extends from the cylindrical base and has a conical section 22 which terminates in a flat upper side 23 with which slide 3 is substantially in alignment. Head portion 2 of stopper 1 as well as slide 3 do not provide a gripping surface in the position shown in FIG. 4 for the exertion of an upwardly directed pulling force on the central part of stopper 1, with which force the press fit or clamping seat of the olive in the receptacle opening could be overcome.

For opening the container the predetermined break seam 13 is torn open, whereupon sealing ring 4 can be torn off along the circular predetermined break seam 10. Slide 3 can then be pushed laterally beyond the upper edge of the opening of the receptacle, which action is facilitated by a recessed grip 24 in the upper side of slide 3. The retracted initial position of slide 3 is ensured by a projection 25 in the bottom area of the movement path of slide 3. This position is overcome by applying an advance or pushing force. The advanced or extended position of slide 3 is defined by a stop 26.

When an attempt is made to lift off stopper 1 from receptacle 7 by applying a force, which is directed upwards in FIG. 4, to the lower edge 27 of sealing ring 4, the predetermined break seam 10 is bound to tear because the stopper proper does not follow this upwardly directed movement because of the clamping seat of olive 6 in the receptacle opening. This protects the receptacle against unauthorized interference in a reliable way.

The upper attachment of the blocking circumferential segment may be formed from an extension of the cylindrical wall section, whose folding away can be made impossible by taking suitable measures. This wall extension may be provided in addition to a circular or annular wall section which is connected to the head portion via a predetermined break seam.

Furthermore, it is within the scope of the invention to dispense with the arrangement of the slide and the blocking circumferential section in a simplified embodiment. The circular predetermined break seam which is located radially inwards with respect to the cylindrical circumferential wall forms a reliable means for ensuring an original state as long as the stopper cannot be pulled by its head in the release direction. After the sealing ring has been removed, a suitable gripping surface, recessed grip, etc. can be exposed.

we claim:

1. An improved stopper and receptacle wherein the receptacle has an upper edge defining an opening and an annular projection around said receptacle, and wherein said stopper compresses a lower portion engageable in said receptacle opening, an upper portion, and a slide in said upper portion, said slide being movable laterally outwardly on a path beyond the edge of the stopper to provide a means for removing the stopper, and a tear-off sealing ring surrounding said stopper and having an annular inner bead gripping below said annular projection of said receptacle, wherein the improvement comprises said sealing ring having an outer diameter greater than the upper portion of the stopper and connected to said stopper, a break seam between the stopper and sealing ring, and a segment on said sealing ring projecting into the path of said slide and preventing outward movement of the slide until removal of the sealing ring.

2. An improved stopper and receptacle according to claim 1, wherein said sealing ring comprises a substantially cylindrical circumferential wall surrounding the upper edge of said receptacle, and an annular wall bent inwards by about 90°, said annular wall being connected, except at said segment, to said upper portion by a circular break seam.

3. An improved stopper and receptacle according to claim 1, wherein said sealing ring has an annular wall resting on the upper edge of said receptacle which the stopper engaged in the receptacle opening.

4. An improved stopper and receptacle according to claim 1, wherein said segment comprises a corner portion having a cylindrical circumferential wall merging into a freely ending circular wall having a reduced cross-sectional thickness.

5. An improved stopper and receptacle according to claim 1, wherein said segment has a width which is substantially identical with the width of said slide.

6. An improved stopper and receptacle according to claim 1, wherein the annular bead of said sealing ring has substantially the shape of a truncated cone when viewed in cross-section.

7. An improved stopper and receptacle according to claim 1, wherein the annular projection of said receptacle comprises an outwardly projecting wall which is substantially at right angles with the longitudinal axis of said receptacle.

8. An improved stopper and receptacle according to claim 1, wherein said segment is devoid of said annular bead.

9. An improved stopper and receptacle according to claim 1, wherein the upper portion of said stopper includes a conical section.

10. An improved stopper and receptacle according to claim 1, wherein said slide ends substantially flush with the upper edge of said receptacle.

11. An improved stopper and receptacle according to claim 1, wherein the upper edge of said receptacle has a recessed annular shoulder, and a portion of said stopper is in engagement with said shoulder.

12. An improved stopper and receptacle according to claim 1, wherein said segment is connected by at least one vertical break seam to the sealing ring.

13. An improved stopper and receptacle according to claim 12 wherein said segment is connected to said sealing ring by a vertical integral hinge which is circumferentially spaced from said break seam.

* * * * *